US008863329B2

(12) United States Patent
Gangan et al.

(10) Patent No.: US 8,863,329 B2
(45) Date of Patent: Oct. 21, 2014

(54) INFANT ACCESSORY FOR SIDE AND THORACIC PRESSURE AID

(75) Inventors: Mansai Gangan, Hudson, MA (US); Susan Sofia-McIntire, Newburyport, MA (US)

(73) Assignee: Nested Bean Inc., Hudson, MA (US)

( * ) Notice: Subject to any disclaimer, the term of this patent is extended or adjusted under 35 U.S.C. 154(b) by 0 days.

(21) Appl. No.: 13/467,398

(22) Filed: May 9, 2012

(65) Prior Publication Data

US 2012/0284922 A1 Nov. 15, 2012

Related U.S. Application Data

(60) Provisional application No. 61/483,851, filed on May 9, 2011, provisional application No. 61/560,184, filed on Nov. 15, 2011.

(51) Int. Cl.
*A41B 13/06* (2006.01)

(52) U.S. Cl.
CPC ..... *A41B 13/06* (2013.01); *A41B 2400/32* (2013.01)
USPC ..... 5/494; 5/655; 2/69.5

(58) Field of Classification Search
USPC ..... 5/494, 502, 655; 2/69.5; 128/872, 873
See application file for complete search history.

(56) References Cited

U.S. PATENT DOCUMENTS

| | | | |
|---|---|---|---|
| 1,584,853 | A | 5/1926 | Dern |
| 3,854,156 | A | 12/1974 | Williams |
| 4,688,282 | A | 8/1987 | Jeffries |
| 5,129,406 | A | 7/1992 | Magnusen et al. |
| 2003/0226190 | A1 | 12/2003 | Jackson |
| 2006/0016005 | A1 | 1/2006 | Roda |
| 2006/0174410 | A1 | 8/2006 | Mastandrea |
| 2007/0028382 | A1 | 2/2007 | Field |
| 2007/0028387 | A1 | 2/2007 | Mathis |
| 2008/0289109 | A1 | 11/2008 | Jackson |
| 2009/0013473 | A1 | 1/2009 | Williams |

FOREIGN PATENT DOCUMENTS

| | | |
|---|---|---|
| GB | 2466944 | 7/2010 |

OTHER PUBLICATIONS

International Search Report mailed Jan. 25, 2013 in corresponding International Application No. PCT/US2012/064774.

Spence, J.E., Quantitative research on therapeutic touch. An integrative review of the literature 1985-1995., Scand J. Caring Sci, 1997 ; 11(3):183-90; http://www.ncbi.nlm.nih.gov/pubmed?term=9349060.

(Continued)

*Primary Examiner* — Brittany Wilson
(74) *Attorney, Agent, or Firm* — Chapin IP Law, LLC

(57) ABSTRACT

A wearable or swaddling accessory blanket provides gentle pressure on the side and/or on the thoracic area of an infant to mimic the human hold. The wearable garment or swaddling blanket appliance includes integrated protrusions in the form of pressure accessories for simulating the slight pressure felt from a caregiver when holding or cradling an infant. The pressure accessories are enlarged or expanded areas disposed at locations on a textile base such as a blanket such that they approximate the arm and hand positions of a caregiver when the swaddling appliance is engaged by wrapping around an infant. Wings or flaps of the appliance facilitate engaging the appliance around an infant such that tension in the wrapped blanket appliance induce a slight inward pressure on the pressure accessories such that the infant perceives the pressure and interprets a caregiver hold or touch.

23 Claims, 5 Drawing Sheets

(56) References Cited

OTHER PUBLICATIONS

Ireland, et al., Massage therapy and therapeutic touch in children: state of the science., Altern Ther Health Med, Sep. 2000; 6(5):54-63; http://www.ncbi.nlm.nih.gov/pubmed?term=10979162.

Tollenaar, et al., Solitary sleeping in young infants is associated with heightened cortisol reactivity to a bathing session but not to a vaccination., Psychoneuroendocrinology, Feb. 2012; 37(2): 167-77; http://www.ncbi.nlm.nih.gov/pubmed?term=21530088.

Goleman, D., The Experience of Touch: Research Points to a Critical Role, The New York Times, Science, Feb. 2, 1988.

INFANT ACCESSORY FOR SIDE AND THORACIC PRESSURE AID

CROSS REFERENCE TO RELATED APPLICATIONS

This patent application claims the benefit under 35 U.S.C. §119(e) of U.S. Provisional Patent Application No. 61/483,851 filed on May 9, 2011, entitled, "INFANT ACCESSORY FOR SIDE AND THORACIC PRESSURE AID," and Application No. 61/560,184, filed Nov. 15, 2011, entitled "INFANT ACCESSORY FOR SIDE AND THORACIC PRESSURE AID," the contents and teachings of which are hereby incorporated by reference in their entirety.

BACKGROUND

Various studies in infant care suggest the importance and significance of a physical touch from a parent or caregiver. Such a physical touching sensation is perceived by an infant as a comforting and reassuring indication, and results in quantifiable physiologic changes exhibited by the infant, as further attested in these studies.

Typically, the touching sensation emanates from the arm and/or hand of the caregiver, and often stems from the natural position of the infant as it is held or cradled by the caregiver. Quite frequently, an uninterrupted touching sensations as that resulting from cradling will facilitate the onset of sleep, stemming from the relaxation and security resulting from the touch sensation.

SUMMARY

A wearable garment or swaddling blanket appliance includes integrated protrusions in the form of pressure accessories for simulating the slight pressure felt from a caregiver when holding or cradling an infant. The pressure accessories are enlarged or expanded areas disposed at locations on a textile base such as a blanket in a manner that they approximate the arm and hand positions of a caregiver when the swaddling appliance is engaged by wrapping around an infant. Wings or flaps of the appliance facilitate engaging the appliance around an infant such that tension in the wrapped blanket appliance induce a slight inward pressure on the pressure accessories so that the infant perceives the pressure and interprets a caregiver hold or touch.

Configurations herein are based, in part, on the observation that a human caregiver may not always be present or able to provide a continuous touching sensation, particularly of a sufficient duration to bring on sleep in an infant. Unfortunately, attempts to soothe an infant to sleep by providing a touching sensation through holding or cradling can be nullified by an external interruption of the caregiver or an attempt to release the touch prematurely, as in setting the infant in a crib.

Soon after birth, many infants show difficulty sleeping or resting in their beds away from their caregivers. Infants, when held by their caregivers, have support on their side as the caregiver holds the infant against their body or by putting their arms around the baby. The infants also may have support on their thoracic area as the caregiver puts a gentle hand on their chest or abdomen area. This type of pressure creates a warm embrace, in which the infant feels secure. When this hold is mimicked via a mechanism, it creates the same effect as being held by a caregiver. This helps the infant rest better and longer.

Accordingly, configurations herein substantially overcome the shortcomings of attempts to apply a continuous touch sensation by providing a swaddling appliance formed from a textile or blanket base having pressure accessories in the form of weighted pockets or padded regions having a mass or bulk greater than the surrounding blanket so as to provide an increased pressure simulating a caregivers arm or hand when the base is wrapped around the infant, similar to a swaddling blanket. The pressure accessories therefore form enlarged and heavier protrusions from the otherwise planar surface of the textile base, and these protrusions engage the infant with a mild pressure so as to simulate pressure applied by a caregiver's touch. The pressure accessories are filled with a bulky and/or weighted substance, such as pellets, beads or padding, that when applied with the textile base provide an increased pressure than the textile base as a whole from the additional weight and volume of the pressure accessory in conjunction with gravity and the tension of a wrapped blanket (textile base). In this manner, the pressure accessory can convey a similar perception to the infant as that of a cradling arm or hand of a caregiver, and therefore elicit similar physiologic responses indicative of comfort, relaxation and security.

The intent of the shape of the pressure accessories is to somewhat mimic human arms that have joints at the wrist and elbow which along with the fingers allow them to bend and anchor. The same effect is achieved by the weighted, elongated pressure accessories with respect to pressure applied along the length of an infant's torso when the accessory is engaged in proximity to the infant as the infant falls asleep and while sleeping. When the pressure accessories are disposed via flaps of the appliance on either side of the baby's body, their weighted quality facilitates positioning close to the infant's body creating a snug embrace around the baby. The sensation felt by the infant is thus closer to the feel and sensation of a human being holding the infant.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Depicted below are example configurations of the swaddling appliance that applies the side and thoracic pressure on an infant's body when lying down for a nap or during sleep time. Further, the disclosure provides examples of a wearable swaddling blanket, a commonly used childcare product for infants, to describe the use of the pressure accessory. The accessory, when either used as is or with subtle variations, also could be adapted for use in many other child care products such as, but not limited to, car seats, bouncy seats, strollers, swaddles etc.

Soon after birth, many infants show difficulty sleeping or resting when they are not being held by their caregivers. They rest best when held by a human. Many a times a sleeping infant will awaken as soon as they are laid down in their bed. This behavior of needing constant holding severely adds to the fatigue of the primary caregiver during the initial months post birth. Swaddling an infant in a blanket is shown to help this behavior and to lengthen sleep time. However in many cases swaddling only increases the independent resting time by merely a few minutes before the infant awakens. Experts attribute this to certain infants taking longer time to enter the state of deep sleep and having shorter sleep cycles. When the baby (infant) is held by a caregiver and if the baby comes out of the deep sleep state and enters a light sleep state, gentle pressure applied by the caregiver's arms and body lulls the baby back into the state of deep sleep without waking the baby up. The infant's sleeping habits gradually get better as he or she grows beyond 3 to 4 months of age. However the beginning months are typically when the primary caregiver needs the time to catch up on activities while the baby rests.

Figure 1:
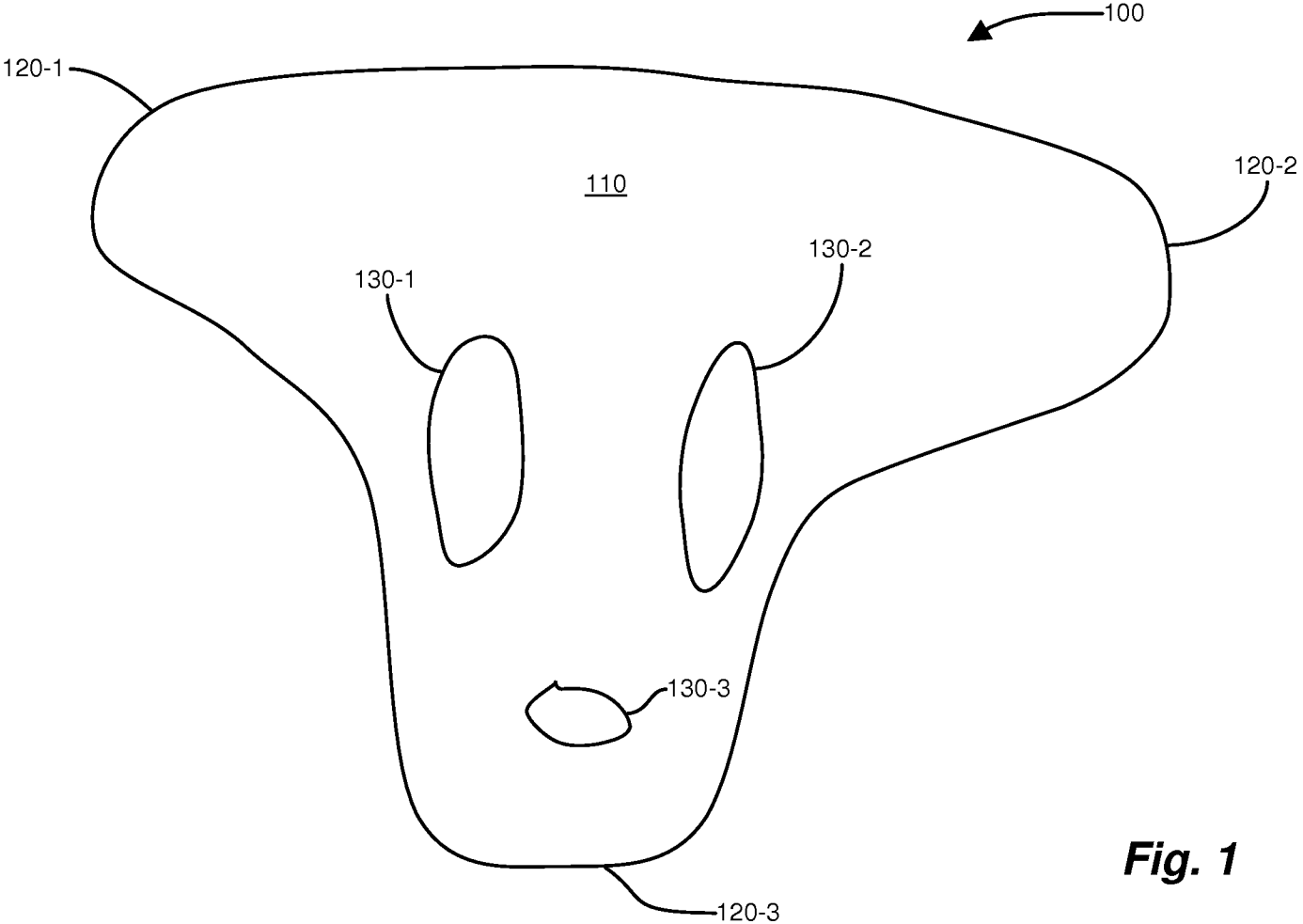
FIG. 1 is a plan view of the unfolded appliance of configurations disclosed herein.

FIG. 1 is a plan view of the unfolded appliance of configurations disclosed herein. Referring to FIG. 1, the swaddling appliance 100 includes a textile base 110 having the general appearance of a blanket sized for wrapping or engaging an infant. In the example configuration, the base 110 includes a plurality of flaps, 120-1 . . . 120-3 (120 generally) or wings having a generally convex shape adapted to wrap around the infant engaged by the swaddling appliance 100. The base also includes one or more pressure accessories 130-1 . . . 130-3 (130 generally) adapted so as to engage the infant by applying slight pressure to the infant when the appliance 100 is wrapped, or engaged around the infant (shown in further detail below). Alternate configurations may also employ the textile base as a swaddling or blanket alone, employing the flaps and optional pockets (discussed further below), and leave the pressure accessories as optional or selectively attachable (as hook-and-loop fastened, frictionally fit or in a separate pocket or hoop.

Figure 2:
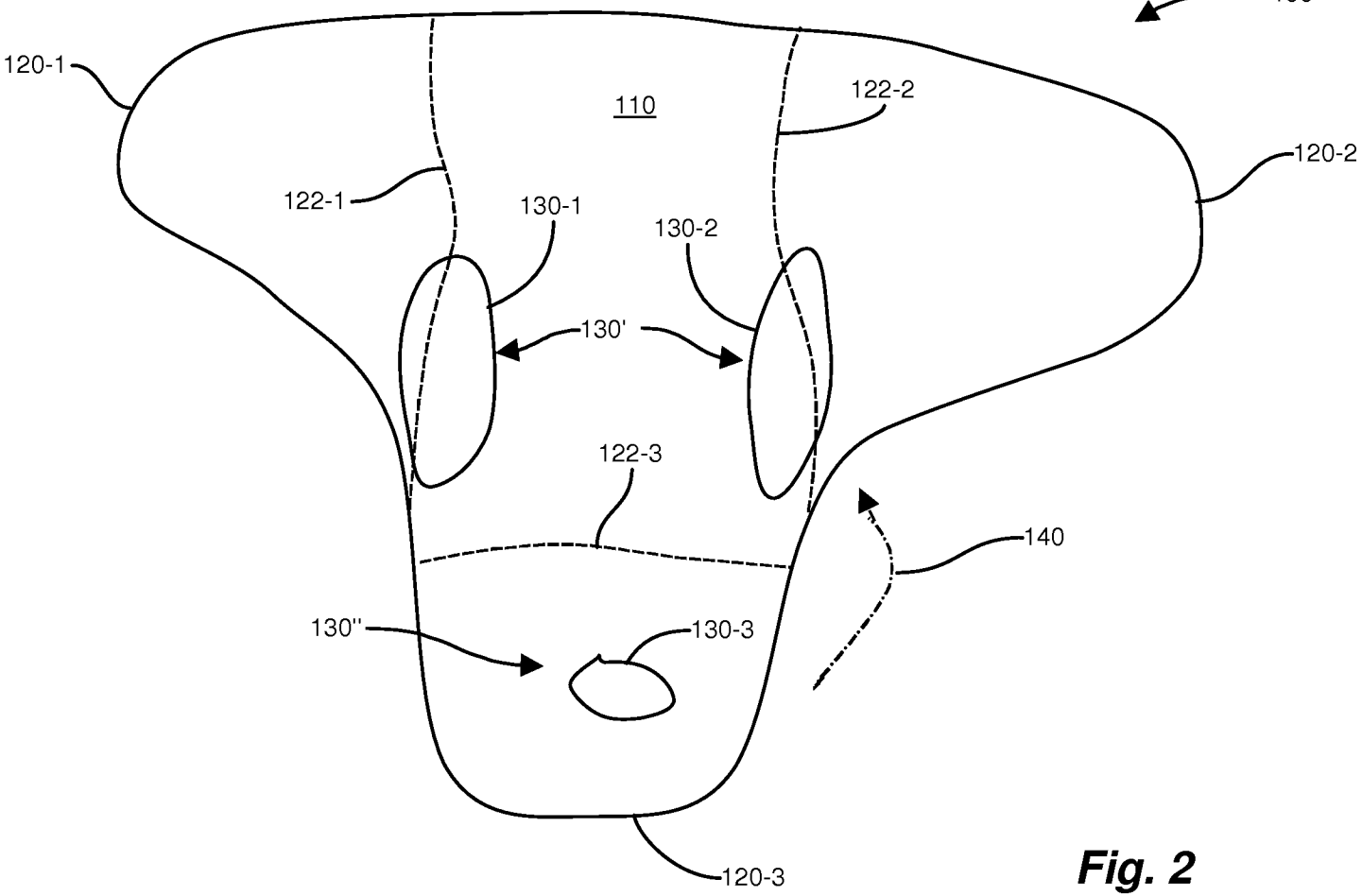
FIG. 2 is a diagram of flaps and corresponding folds of the appliance of FIG. 1.

FIG. 2 is a diagram of flaps and corresponding folds of the appliance of FIG. 1. Referring to FIGS. 1 and 2, the flaps 120 define folds 122-1 . . . 122-3 (122 generally), substantially defining the general region of the appliance 100 that will curve around the body of the wearer infant when the swaddling appliance 100 engages the infant. The side flaps 120-1, 120-2 are adapted to wrap around the torso of the infant and a bottom flap 120-3 wraps around the legs and pelvic region such that the front pressure accessory 130-3 engages a chest region of the wearer infant. Each of the flaps 120, in the example arrangement, includes a corresponding pressure accessory 130, however various arrangements may omit the pressure accessory 130 on one or more of the flaps 120. The flaps 120 and corresponding folds 122 may not necessarily define discrete portions or seams of the textile swaddling appliance 100, but rather general regions of a continuous planar blanket surface that tends to follow the body contour of the infant when wrapped around the infant with sufficient tension to engage the pressure accessories 130 against the infant in the manner described herein for simulating a touch or contact of a caregiver. The swaddling appliance 100 may be formed from a continuous textile material cut and shaped as disclosed herein.

The pressure accessories 130 are generally disposed along a region defined by the folds 122, substantially where the convex shape of the flaps 120 meets the textile base 110. Alternatively, the pressure accessories may be disposed elsewhere, such as on the bottom flap 120-3 in anticipation of folding upward around the infant, shown in FIGS. 5-8 below. The plurality of pressure accessories 130 may be of various shapes, sizes, however in the example arrangement the pressure accessories 130 include lateral chambers 130', or supports, for simulating the forearm of a caregiver holding the infant and a front chamber 130" (support) for simulating the palm of a caregiver. It should be noted that a (horizontal) central point of each side flap (or wing) that wraps is at the chest or torso region so as not to focus excessive pressure on the hips. Such pressure, if centered around the hip region and possibly too tightly wrapped has been suggested to cause dysplasia in infants under three months.

Figure 3:
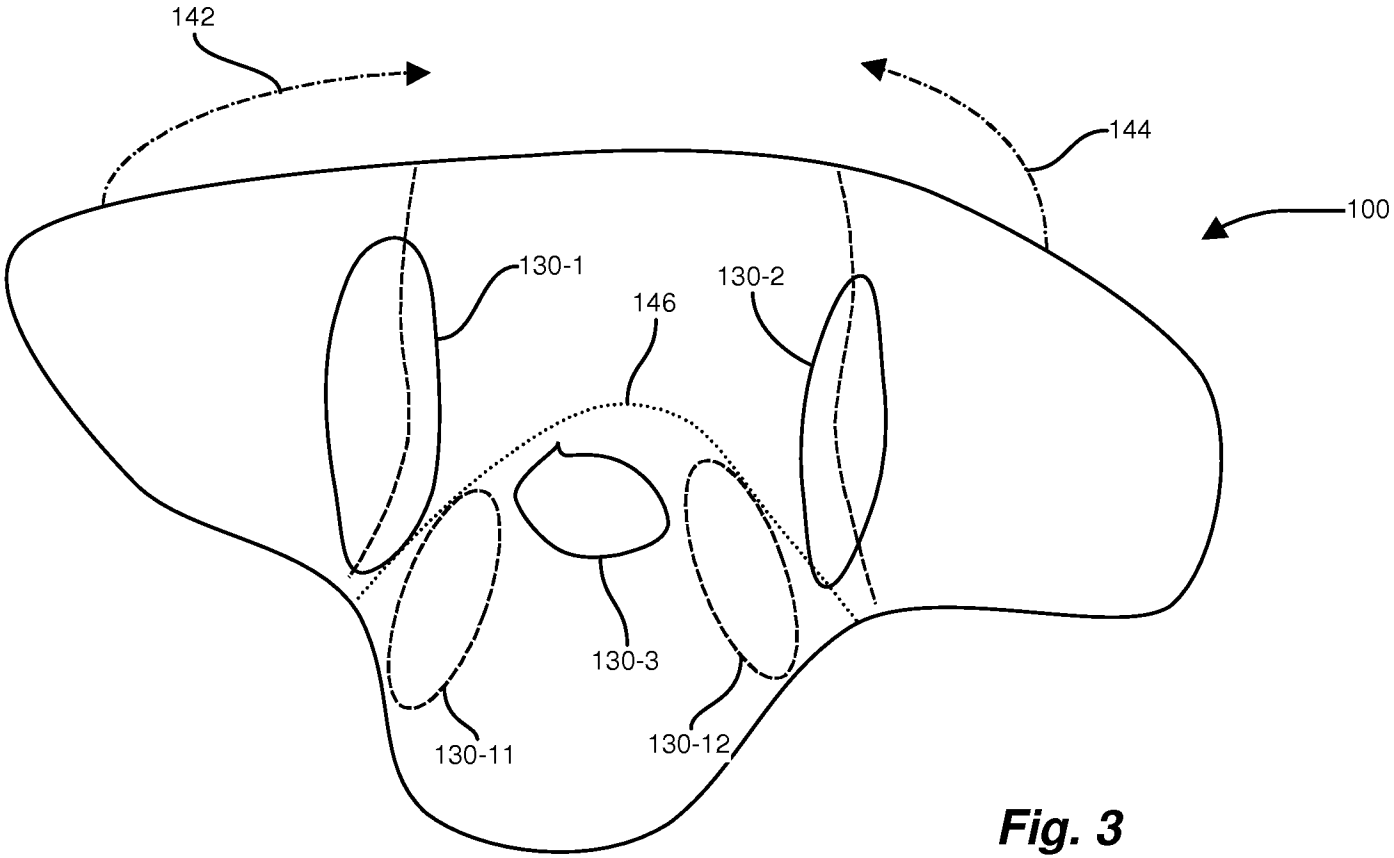
FIG. 3 is a diagram of folding the flaps of FIG. 2 for engaging the pressure accessories against a wearer infant.

FIG. 3 is a diagram of folding the flaps of FIG. 2 for engaging the pressure accessories against a wearer infant. Referring to FIGS. 1-3, the bottom flap 120-3 folds upward as shown by arrow 140, and the side flaps 120-1, 120-2 fold around the left and right sides of the infant as shown by arrows 142 and 144, respectively. Folding the flaps 120-3 orients the front pressure accessory 130-3 in the chest region of the wearer infant, shown by the folded bottom flap 146, and folding the side flaps 120-1, 120-2 orients the lateral (side) pressure accessories 130-1, 130-2 along the right and left sides of the infant, preferably from a region from around the shoulder to mid thigh of the wearer infant. In an alternate configuration, also shown below in FIGS. 5-8, the pressure accessories 130-11, 130-12 may be disposed opposed sides of the lower flap 120-3 such that closure of the bottom flap 120-3 draws the pressure accessories to engage the infant. The pressure accessories 130 may be attached by any suitable mechanism, such as sewn textile pockets, adhered with adhesive, or integrated in layers of the textile base 110. Further, the pressure accessories may be filled with a slightly denser material, such as beads or pellets, so as to increase the pressure sensation from gravitational pull on the weighted material therein. Alternatively, fibrous filling such as polyester may also be employed if additional weight is not desired.

Figure 4:
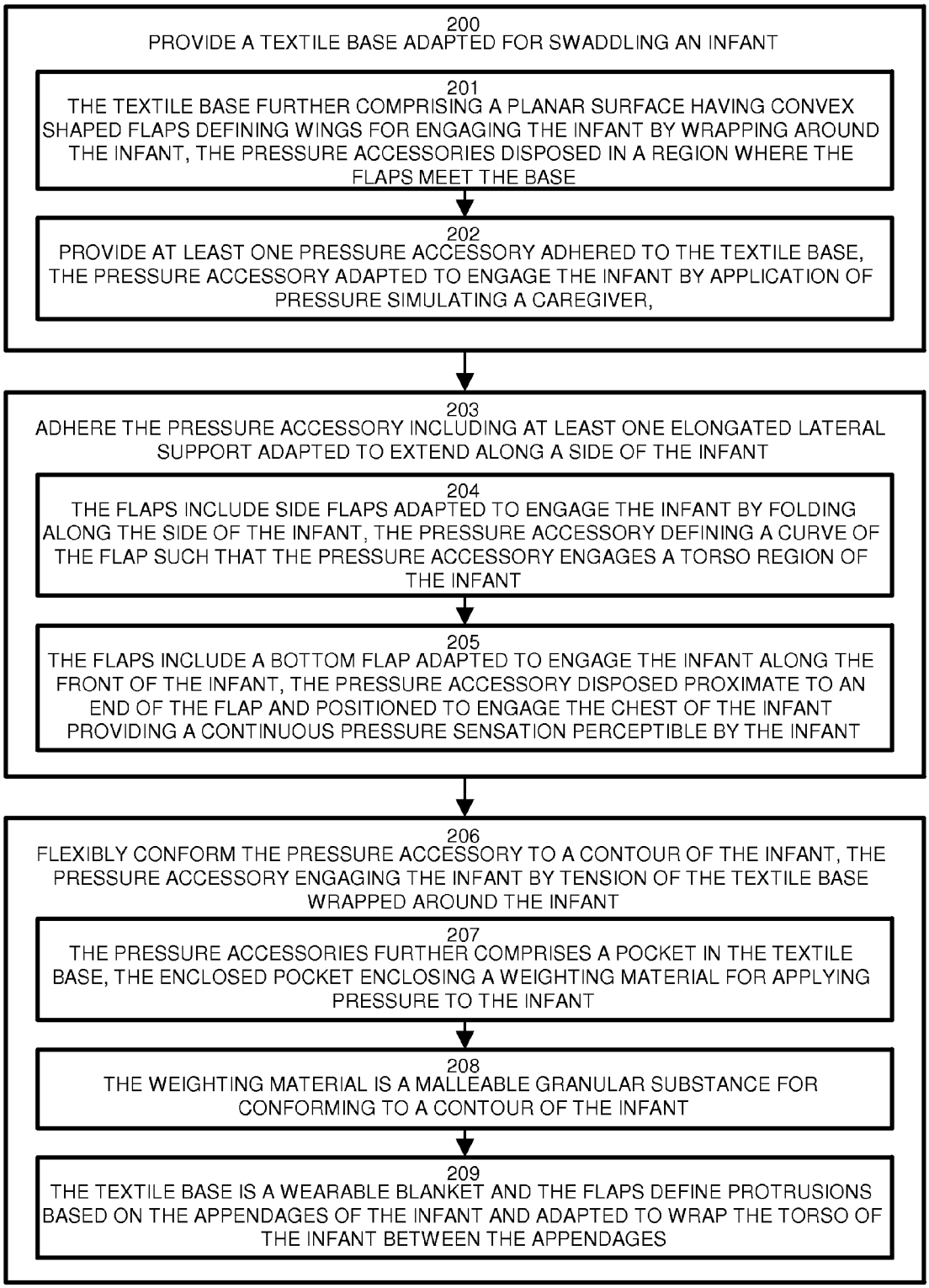
FIG. 4 is a flowchart of usage of the appliance of FIGS. 1-3.
Figure 5:
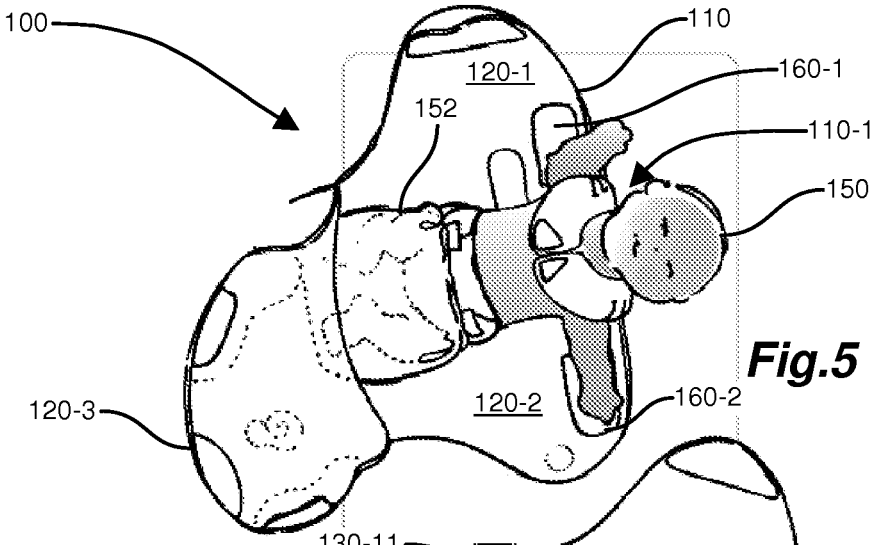
FIG. 5 is a perspective view of an infant prior to engagement with the swaddling appliance.

FIG. 4 is a flowchart of formation and usage of the appliance of FIGS. 1-3. Referring to FIGS. 1-4, a procedural approach to providing and engaging an infant using the disclosed appliance 110 is shown. At step 200, the method for employing the swaddling appliance for engaging an infant includes providing a textile base 110 adapted for swaddling an infant 150 (FIG. 5, below). In the example arrangement, the textile base 110 further includes a planar surface having convex shaped flaps 120 defining wings for engaging the infant 150 by wrapping around the infant 150, such that the pressure accessories 130 are disposed in a region where the flaps 120 meet the base 110, as depicted at step 201. The textile base is a blanket material adapted to drape and wrap around the infant, and may be any suitable textile or fabric-like material of a desired weight for providing texture and warmth.

The textile base 110 incorporates at least one pressure accessory 130 adhered to the textile base 110, such that the pressure accessory 130 is adapted to engage the infant 150 by application of pressure simulating a caregiver, as depicted at step 203. In the example arrangement, the pressure accessory 130 includes at least one elongated lateral support 130-1, 130-2 adapted to extend along a side of the infant. The flaps

120 include side flaps 120-1, 120-2 adapted to engage the infant by folding along the side of the infant, such that the pressure accessory 130 defines a curve of the flap such that the pressure accessory engages a torso region of the infant 150, as shown at step 204. The elongated lateral supports defining the side pressure accessories 120-1, 120-2 extend substantially from a shoulder of the infant to a mid thigh region.

The flaps 120 further include a bottom flap 120-3 adapted to engage the infant 150 along the front of the infant, such that the pressure accessory 130-3 becomes disposed proximate to an end of the flap 146 and positioned to engage the chest of the infant 150, thereby providing a continuous pressure sensation perceptible by the infant, as shown at step 205. In alternate arrangement, the textile base may further include a leg pouch 152 in the region of the bottom flap 120-3, such that the leg pouch 152 (FIG. 5, below) is adapted to be covered by the bottom flap 120-3 upon folding.

Engaging (swaddling) the infant further includes flexibly conforming the pressure accessory to a contour of the infant, as depicted at step 206, such that the pressure accessory engages the infant 150 by tension of the textile base 110 wrapped around the infant 150, as depicted at step 206. Either of the torso pressure accessory 130-3 or the side accessories 130-1, 130-2 may comprise a pocket in the textile base 110, such that the enclosed pocket encloses a weighting material for applying pressure to the infant 150, as shown at step 207. The weighting material may be a malleable granular substance for conforming to a contour of the infant, as depicted at step 208, or the weighting material may include any suitable material adapted to conform to a shape of the flap wrapped around the infant. Such a weighted material may comprise poly beads, Styrofoam beads, hypoallergenic material, and/or various organic materials such as walnut shells or buckwheat. Depending on the weighted filler, the pocket may be define a plurality of compartments, each of the compartments including a portion of the weighting material.

The weightiness or firmness within the bars is created by using a heavier filling that, for example plastic pellets. Such a filling offers a gentle pressure, would move with the baby's light movements. The weight offered by the weighted intervals is determined in such a way that it mimics the weight offered by the human hand on a resting baby, for example it can be approximately 0.25 to 0.5 lbs. The density of the soft filling is chosen to allow it to be flexible so that it bends and takes the desired shape and position without being too rigid. It is to be understood that various configurations of different density filing materials and different placements and spacing of these materials within the elongated bars is within the scope of the invention disclosed herein and the specific disclosed embodiments are not intended to be limiting.

Thus, the textile base 110 defines a wearable blanket and the flaps 120 define protrusions based on the appendages of the infant and adapted to wrap the torso of the infant 150 between the appendages, depicted at step 209. The textile base appears as an infant garment forming receptacles for appendages of the infant.

FIG. 5 is a perspective view of an infant prior to engagement with the swaddling appliance. Referring to FIGS. 1-3 and 5, an infant 150 lies on the textile base 110 prior to engagement with the device 100. An optional pouch 152 encases the legs for smaller infants who may not fill out the folded bottom flap 120-3. The bottom flap 120-3 is partially engaged (draw over the legs of the infant 150

Figure 6:
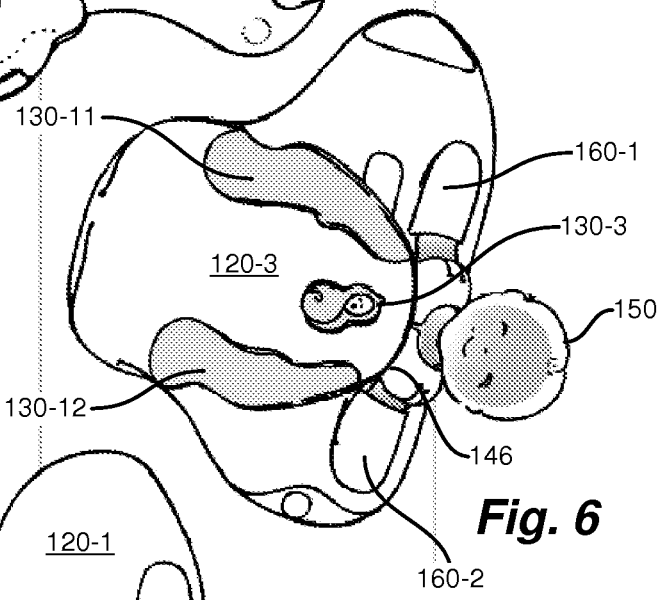
FIG. 6 is a perspective view of engagement of the bottom flap (wing) of the swaddling appliance.

FIG. 6 is a perspective view of engagement of the bottom flap (wing) of the swaddling appliance. Referring to FIG. 6, the bottom flap 120-3 is drawn or pulled over the torso of the infant 140, and the pressure accessories 120-1, 120-2 engaging the lateral sides of the infant and the center pressure accessory 130-3 engaging the chest area.

Figure 7:
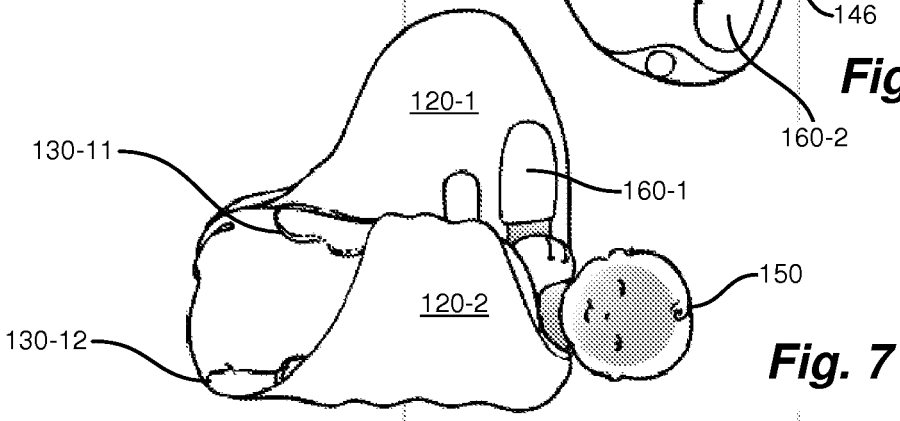
FIG. 7 is a perspective view of engagement of the left flap (wing) of the swaddling appliance.

FIG. 7 is a perspective view of engagement of the left flap (wing) of the swaddling appliance 100. In FIG. 7, the left flap 120-2 is drawn to engage the infant 150 such that the pressure accessories 120-11, 120-13 are drawn or pressed into engagement with the infant 150 by the tension of the drawn flap 120-2.

Figure 8:
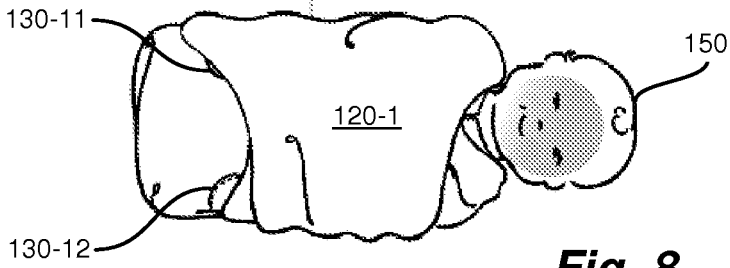
FIG. 8 is a perspective view of a fully engaged swaddling appliance around an infant.
Figure 1:
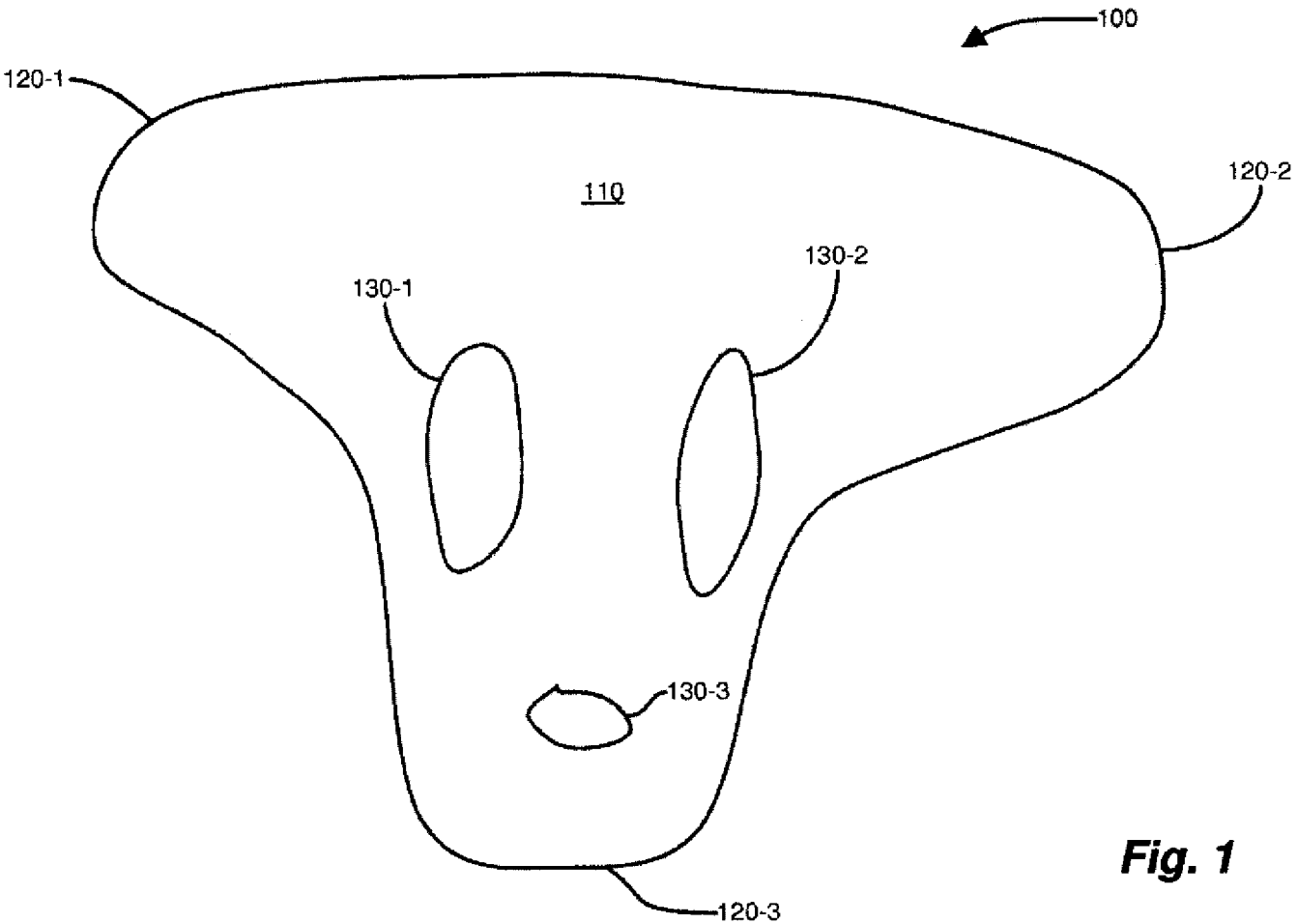
Figure 2:
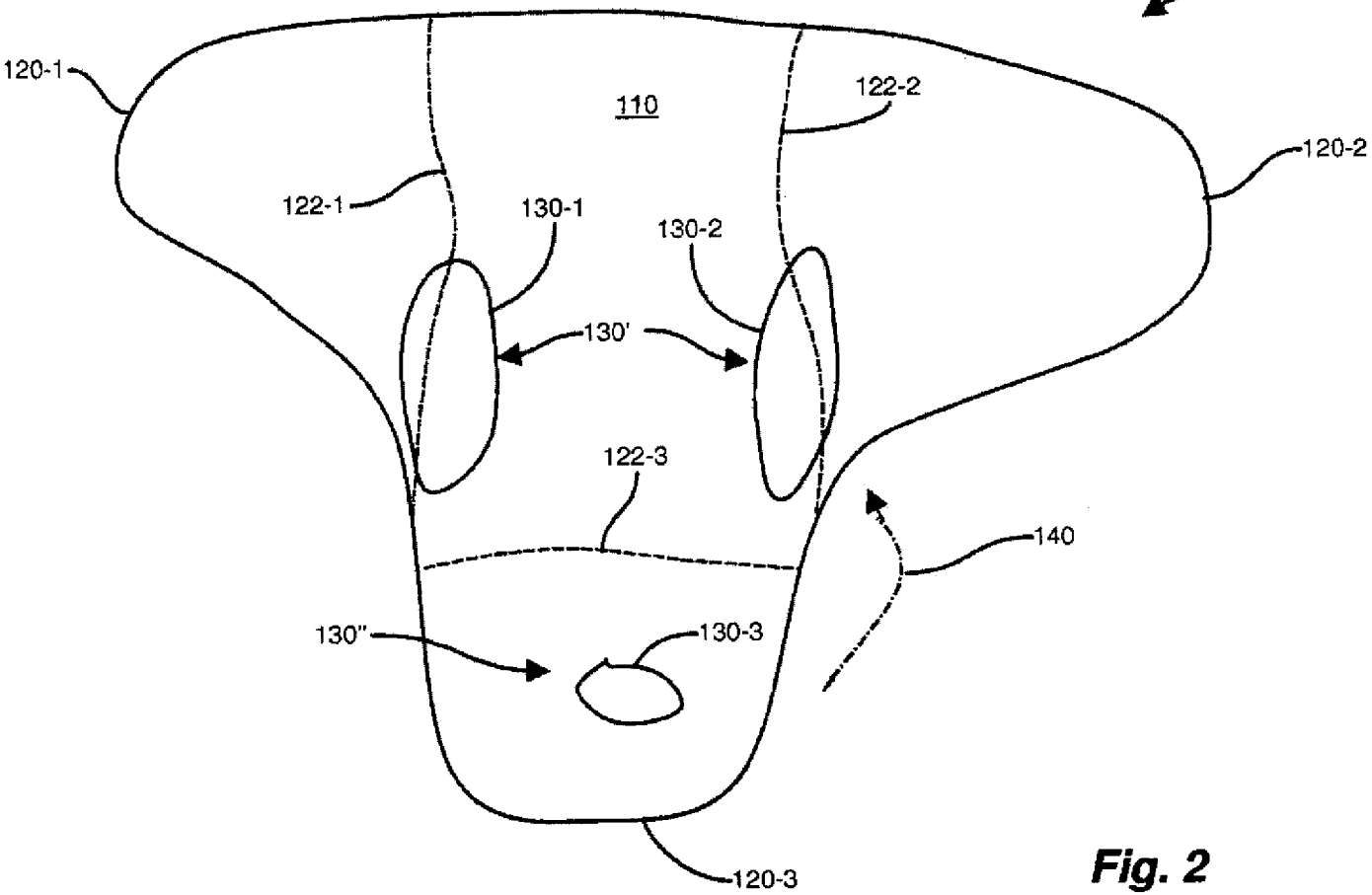
Figure 3:
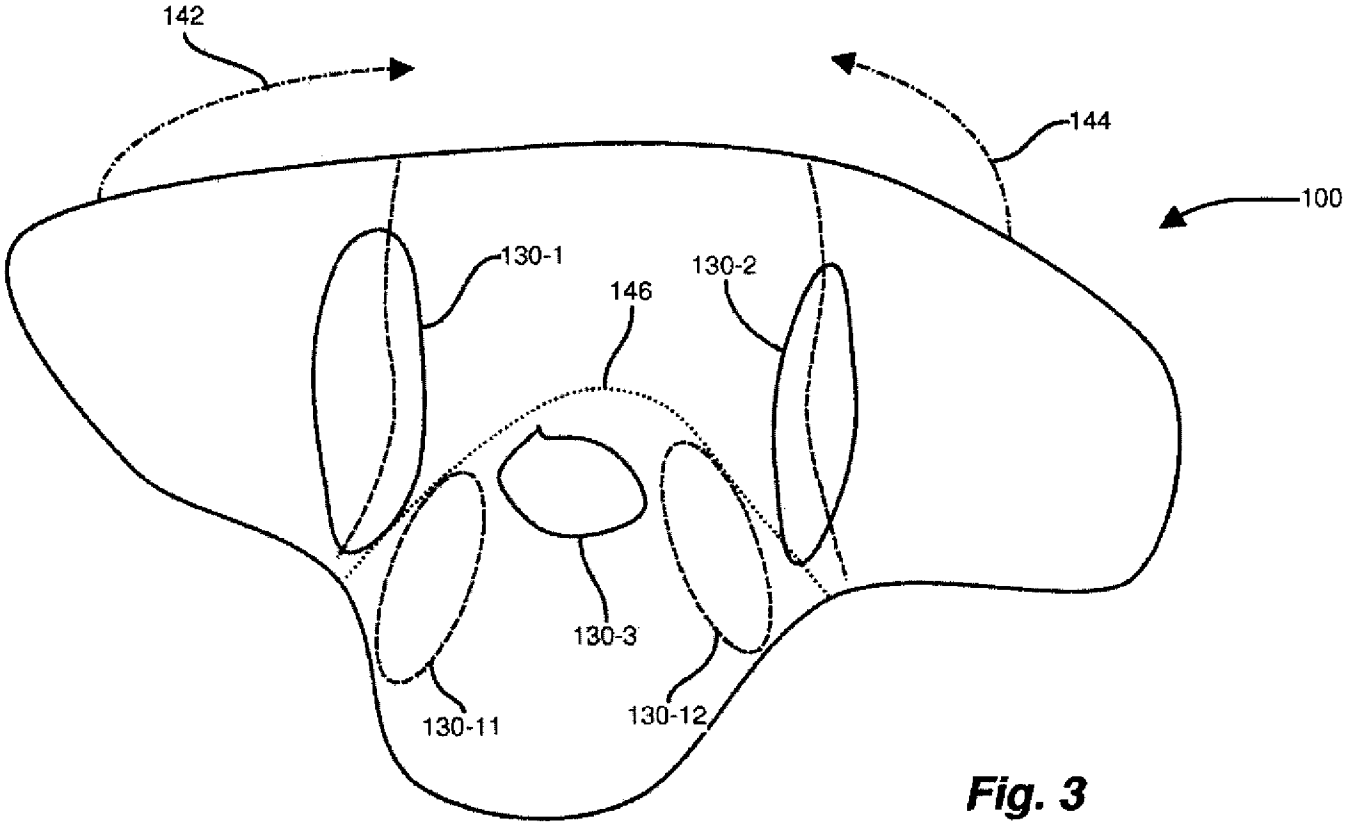
Figure 4:
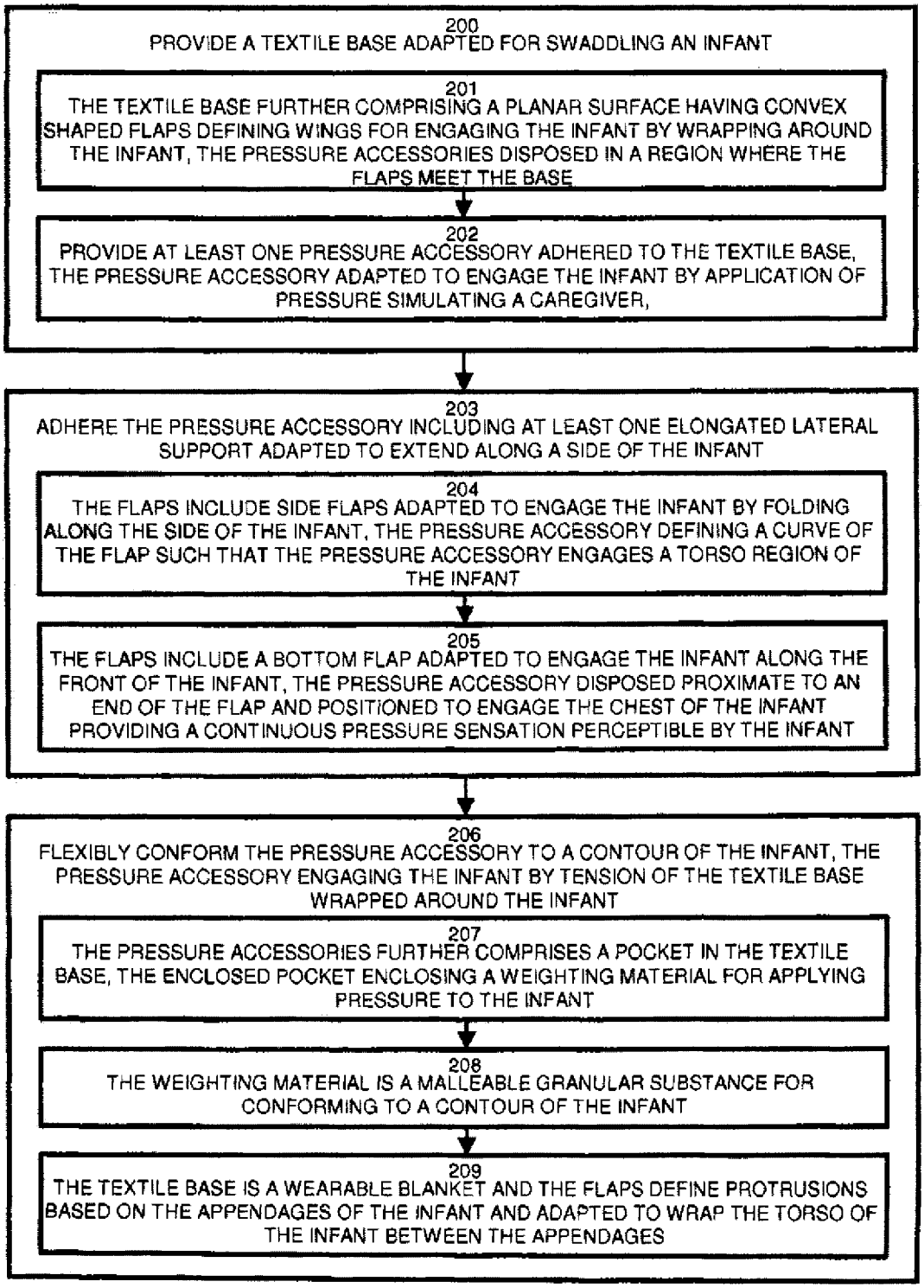
Figure 5:
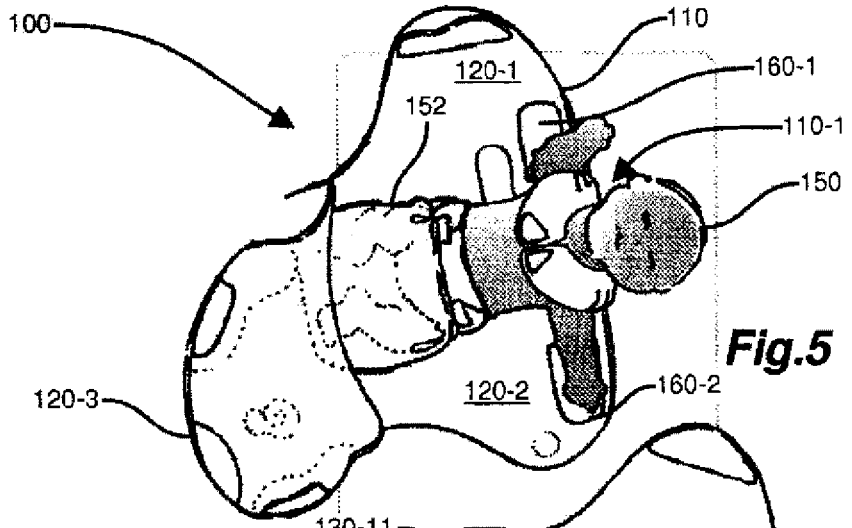
Figure 6:
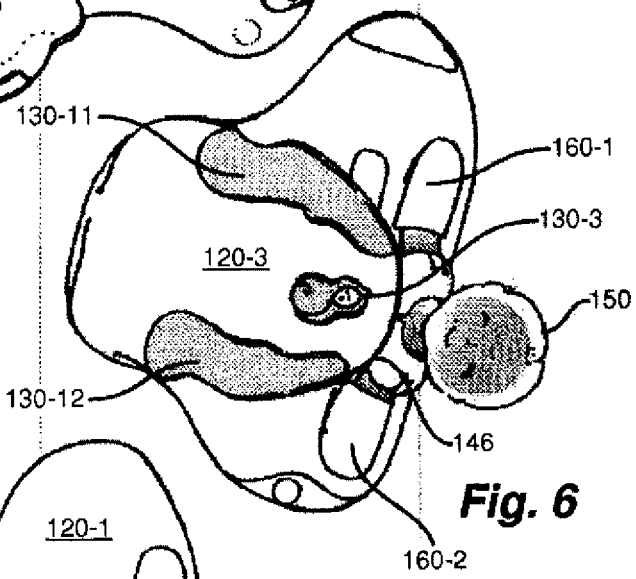
Figure 7:
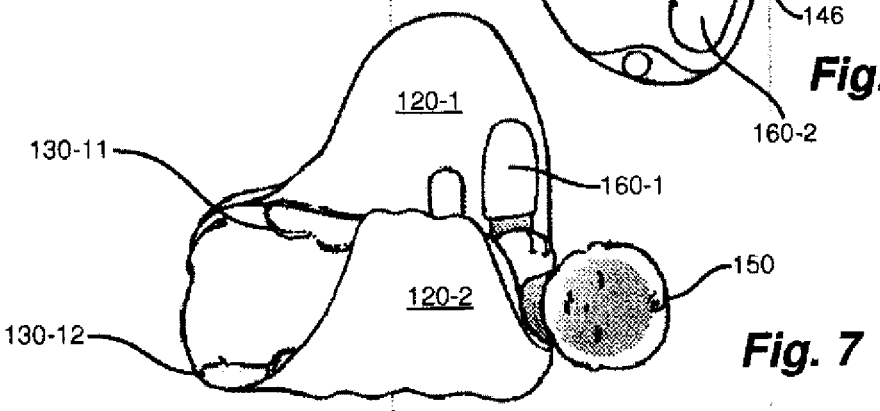
Figure 8:
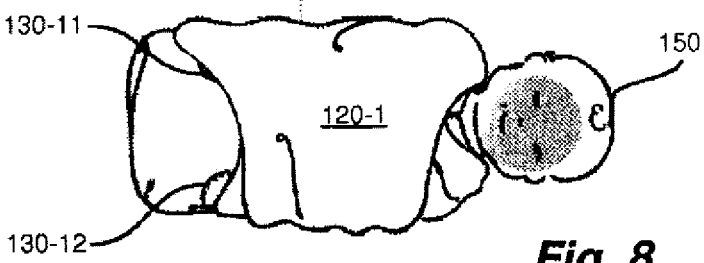

FIG. 8 is a perspective view of a fully engaged swaddling appliance around an infant. Referring to FIGS. 5-8, the right flap (from the infant 150 perspective) is drawn over the left flap 120-2 and around the infant 150 to further engage the pressure appliances 130.

The paragraphs below describe the step by step mechanism to secure the swaddle blanket on the baby with help of FIGS. 5-8. As shown in FIG. 5, the infant is placed in prone position on the textile base 110 with the base of infant's neck aligned with the top edge of a back panel 110-1 defined by the center of the base 110 between the flaps 120-1, 120-2. In the case where the leg pouch 152 is present and being used, the infant's legs are inserted into the pouch 152 and the open end of the leg pouch is extended upwards over the infant's waist to the maximum possible extent.

As shown in FIG. 6, particular configurations may employ hand pockets 160-1, 160-2 (160 generally) which may be employed with either or both hands placed inside the pockets such that the finger tips extend to the enclosed U-shaped end of the pocket while the open end of the pocket extends above the infant's elbow. Engagement pulls the front panel upwards, to cover the infant's body until the top edge of each side, and the pressure accessories 130 are tucked under the respective arms. Engagement of the infant (i.e. wrapping or swaddling) should tuck each side pressure accessory 130-1, 130-2 along the side of the infant's body. In this position pressure is exerted on the infant on both the sides. In the case where a shoulder panel is present and being used, both sides of the panel may be extended over the infant's shoulders on to the infant's chest and thus under to the front panel. Secure the two ends of the shoulder panel to the front panel using hook and loop fastener pair, as shown in the figure. In this position, the thoracic pressure accessory lies along the vertical line somewhere between the chest and the waist of the infant.

FIGS. 7 and 8 show how the swaddle is wrapped around the baby's body. As shown in FIG. 7 one flap 120 is wrapped over the infant's shoulder and arm. It is then extended to the opposite side and tucked under the infant's back. A hook and loop fastener pair may be used to secure end in this position as shown. In this position, the side pressure accessory 130-1 or 130-2 may be covered partially or completely and secured in place along the wrapped side of the infant. Now, as shown in FIG. 8 the other end (flap 120) of the base defining the flap 120 is wrapped over the infant's other shoulder and arm, extended to the opposite side over the wrapped arm, tucked under the back and secured using hook and loop fastener or other suitable attachment, as shown. In this position, the side pressure accessories 130-1, 130-2 are further secured in place along the side of the infant.

While the disclosed system and method has been particularly shown and described with references to embodiments thereof, it will be understood by those skilled in the art that various changes in form and details may be made therein without departing from the scope of the invention encompassed by the appended claims.

The invention claimed is:

1. A blanket garment appliance for engaging an infant comprising:

a textile base adapted for engaging an infant, the textile base further comprising a planar surface having at least one convex shaped flap defining a wing for engaging the infant by wrapping around the infant; and at least one pressure accessory adhered to the textile base, the pressure accessory adapted to engage the infant by application of pressure simulating a caregiver, the pressure accessory adapted to flexibly conform to a contour of the infant for providing a continuous pressure sensation greater than that exerted by the planar surface alone and perceptible by the infant the flaps further comprising a bottom flap adapted for folding upward over a chest of the infant having said at least one pressure accessory disposed proximate to an end of the bottom flap and positioned to engage the chest of the infant upon upward folding; and a plurality of opposed side flaps for wrapping around a torso of the infant;

each of the flaps configured to draw the pressure accessories into ergonomic conformance with a contour of the infant for providing the continuous pressure sensation.

2. The appliance of claim 1 wherein the pressure accessory engages the infant by tension of the textile base swaddled around the infant.

3. The appliance of claim 1 wherein the pressure accessory includes at least one elongated lateral support adapted to extend along a side of the infant.

4. The appliance of claim 3 wherein the elongated lateral support extends substantially from a shoulder of the infant to a mid thigh region.

5. The appliance of claim 1 wherein the flaps include at least one side flap adapted to engage the infant by folding along the side of the infant, the pressure accessory disposed on the textile substrate such that the pressure accessory engages a torso region of the infant upon folding of the side flaps.

6. The appliance of claim 1 wherein the bottom flap further comprises a plurality of pressure accessories on opposed sided of the bottom flap, each of the pressure accessories disposed to engage a respective side of the infant upon upward folding of the bottom flap.

7. The appliance of claim 1 wherein the textile base further comprises a leg pouch adapted to be covered by the bottom flap upon folding.

8. The appliance of claim 1 wherein the pressure accessory further comprises a pocket in the textile base, the enclosed pocket enclosing a weighting material for applying pressure to the infant.

9. The appliance of claim 8 wherein the weighting material is a malleable granular substance for ergonomically conforming to a contour of the infant.

10. The appliance of claim 8 wherein the pocket comprises a plurality of compartments, each of the compartments including a portion of the weighting material.

11. The appliance of claim 1 wherein the textile base is a wearable blanket for accommodating the appendages of the infant and adapted to wrap the torso of the infant between the appendages.

12. The appliance of claim 1 wherein the textile base is an infant garment having flaps positioned to engage the pressure accessories for applying the continuous pressure sensation.

13. The appliance of claim 1 wherein the pressure accessory further comprises a thoracic pressure accessory disposed along a line between the chest and the waist of the infant.

14. The appliance of claim 1, wherein the convex shaped flaps define wings for engaging the infant by wrapping around the infant, such that the pressure accessories are disposed in a region where the convex shaped flaps meet the base in a fold.

15. The appliance of claim 1, wherein the continuous pressure sensation exerts a force that mimics the weight of a caregivers hand.

16. The appliance of claim 15, wherein the force exerted is based on a percentage of the weight of the infant.

17. A method for simulating an infant caregiver's touch comprising:

providing a textile base adapted for engaging an infant the textile base further comprising a planar surface having convex shaped flaps defining convex extensions in the planar surface for engaging the infant by wrapping around the torso of the infant; and adhering at least one pressure accessory to the textile base, the pressure accessory adapted to engage the infant by application of pressure simulating a caregiver, the pressure accessory adapted to flexibly conform to a contour of the infant for providing a continuous pressure sensation greater than that exerted by the planar surface alone and perceptible by the infant; and the convex shaped flaps including a bottom flap having at least one pressure accessory disposed proximate to an end of the bottom flap and positioned to engage the chest of the infant upon upward folding.

18. The method of claim 17 wherein the flaps include side flaps adapted to engage the infant by folding along the side of the infant, the pressure accessory disposed on the textile substrate such that the pressure accessory engages a torso region of the infant upon wrapping of the flaps.

19. The method of claim 17 further comprising:

folding a bottom flap upward over a chest of the infant; and wrapping a plurality of opposed side flaps around a torso of the infant, each of the flaps configured to draw the pressure accessories into ergonomic conformance with a contour of the infant for providing the pressure sensation;

wherein the flaps include a bottom flap adapted to engage the infant along the front of the infant;

at least one pressure accessory disposed proximate to an end of the bottom flap and positioned to engage the chest of the infant upon upward folding;

a plurality of pressure accessories on opposed sides of the bottom flap, each of the pressure accessories disposed to engage a respective side of the infant upon upward folding of the bottom flap; and the side flaps for engaging the infant and the pressure accessory by wrapping over the bottom flap.

20. A garment, comprising:

a planar base, the base defined by a flexible sheet of garment material;

at least one pressure region on the planar base defining a location at which a touch from a caretaker is expected when the material engages an infant by wrapping the material around the infant;

a pressure accessory adhered to each of the pressure regions, the pressure accessory having a greater mass and bulk than the planar pressure region to which it is adhered;

the pressure accessory configured to apply pressure to the infant at the pressure region, the pressure region based on a determined location on the infant where pressure from a caregiver's arm or hand would be applied to a held infant;

the pressure from the pressure accessory greater than that exerted by the planar base alone; and the planar base further including a plurality of flaps, each of the flaps defining a pressure region, the pressure region configured for engaging the determined location when the flap is wrapped around the infant.

21. The garment of claim 20 wherein the plurality of flaps further comprise right and left side flaps having right and left pressure regions corresponding to right and left torso sides of the infant for simulating a caregivers arm.

22. The garment of claim 21 wherein the pressure accessories further comprise an enlarged and expanded volume greater than the planar base on which they are adhered, disposed at locations on a textile base for approximating the arm and hand pressure of a caregiver when the planer base is engaged by wrapping around the infant.

23. The garment of claim 22 wherein the planar base further includes a front flap, the front flap defining a pressure accessory for a pressure region corresponding to a chest of the infant, the front flap having a pouch for engaging legs of the infant based on an infant size.

* * * * *

UNITED STATES PATENT AND TRADEMARK OFFICE

CERTIFICATE OF CORRECTION

PATENT NO. : 8,863,329 B2
APPLICATION NO. : 13/467398
DATED : October 21, 2014
INVENTOR(S) : Gangan et al.

It is certified that error appears in the above-identified patent and that said Letters Patent is hereby corrected as shown below:

Please delete patent 8863329 in its entirety and insert patent 8863329 in its entirety as shown on the attached pages.

Signed and Sealed this
Twelfth Day of May, 2015

Michelle K. Lee

Michelle K. Lee
*Director of the United States Patent and Trademark Office*

(12) United States Patent
Gangan et al.

(10) Patent No.: US 8,863,329 B2
(45) Date of Patent: Oct. 21, 2014

(54) INFANT ACCESSORY FOR SIDE AND THORACIC PRESSURE AID

(75) Inventors: Manasi Gangan, Hudson, MA (US); Susan Sofia-McIntire, Newburyport, MA (US)

(73) Assignee: Nested Bean Inc., Hudson, MA (US)

( * ) Notice: Subject to any disclaimer, the term of this patent is extended or adjusted under 35 U.S.C. 154(b) by 0 days.

(21) Appl. No.: 13/467,398

(22) Filed: May 9, 2012

(65) Prior Publication Data

US 2012/0284922 A1 Nov. 15, 2012

Related U.S. Application Data

(60) Provisional application No. 61/483,851, filed on May 9, 2011, provisional application No. 61/560,184, filed on Nov. 15, 2011.

(51) Int. Cl.
*A41B 13/06* (2006.01)

(52) U.S. Cl.
CPC ..... *A41B 13/06* (2013.01); *A41B 2400/32* (2013.01)
USPC ..... 5/494; 5/655; 2/69.5

(58) Field of Classification Search
USPC ..... 5/494, 502, 655; 2/69.5; 128/872, 873
See application file for complete search history.

(56) References Cited

U.S. PATENT DOCUMENTS

| | | | |
|---|---|---|---|
| 1,584,853 | A | 5/1926 | Dern |
| 3,854,156 | A | 12/1974 | Williams |
| 4,688,282 | A | 8/1987 | Jeffries |
| 5,129,406 | A | 7/1992 | Magnusen et al. |
| 2003/0226190 | A1 | 12/2003 | Jackson |
| 2006/0016005 | A1 | 1/2006 | Roda |
| 2006/0174410 | A1 | 8/2006 | Mastandrea |
| 2007/0028382 | A1 | 2/2007 | Field |
| 2007/0028387 | A1 | 2/2007 | Mathis |
| 2008/0289109 | A1 | 11/2008 | Jackson |
| 2009/0013473 | A1 | 1/2009 | Williams |

FOREIGN PATENT DOCUMENTS

| | | |
|---|---|---|
| GB | 2466944 | 7/2010 |

OTHER PUBLICATIONS

International Search Report mailed Jan. 25, 2013 in corresponding International Application No. PCT/US2012/064774.

(Continued)

*Primary Examiner* — Brittany Wilson
(74) *Attorney, Agent, or Firm* — Chapin IP Law, LLC

(57) ABSTRACT

A wearable or swaddling accessory blanket provides gentle pressure on the side and/or on the thoracic area of an infant to mimic the human hold. The wearable garment or swaddling blanket appliance includes integrated protrusions in the form of pressure accessories for simulating the slight pressure felt from a caregiver when holding or cradling an infant. The pressure accessories are enlarged or expanded areas disposed at locations on a textile base such as a blanket such that they approximate the arm and hand positions of a caregiver when the swaddling appliance is engaged by wrapping around an infant. Wings or flaps of the appliance facilitate engaging the appliance around an infant such that tension in the wrapped blanket appliance induce a slight inward pressure on the pressure accessories such that the infant perceives the pressure and interprets a caregiver hold or touch.

23 Claims, 5 Drawing Sheets

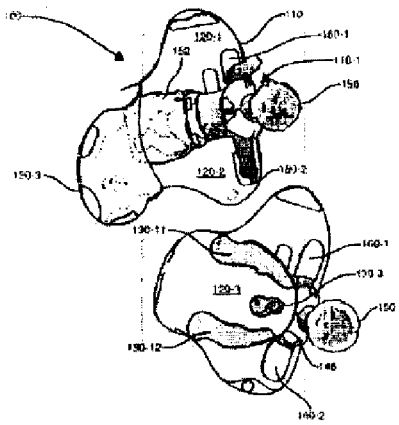

(56) References Cited

OTHER PUBLICATIONS

Spence, J.E., Quantitative research on therapeutic touch. An integrative review of the literature 1985-1995., Soand J. Caring Sci, 1997 ; 11(3):183-90; http://www.ncbi.nlm.nih.gov/pubmed?term=9349060.

Ireland, et al., Massage therapy and therapeutic touch in children: state of the science., Altern Ther Health Med, Sep. 2000; 6(5):54-63; http://www.ncbi.nlm.nih.gov/pubmed?term=10979162.

Tollenaar, et al., Solitary sleeping in young infants is associated with heightened cortisol reactivity to a bathing session but not to a vaccination., Psychoneuroendocrinology, Feb. 2012; 37(2): 167-77; http://www.ncbi.nlm.nih.gov/pubmed?term=21530088.

Goleman, D., The Experience of Touch: Research Points to a Critical Role, The New York Times, Science, Feb. 2, 1988.

INFANT ACCESSORY FOR SIDE AND THORACIC PRESSURE AID

CROSS REFERENCE TO RELATED APPLICATIONS

This patent application claims the benefit under 35 U.S.C. §119(e) of U.S. Provisional Patent Application No. 61/483,851 filed on May 9, 2011, entitled, "INFANT ACCESSORY FOR SIDE AND THORACIC PRESSURE AID," and Application No. 61/560,184, filed Nov. 15, 2011, entitled "INFANT ACCESSORY FOR SIDE AND THORACIC PRESSURE AID," the contents and teachings of which are hereby incorporated by reference in their entirety.

BACKGROUND

Various studies in infant care suggest the importance and significance of a physical touch from a parent or caregiver. Such a physical touching sensation is perceived by an infant as a comforting and reassuring indication, and results in quantifiable physiologic changes exhibited by the infant, as further attested in these studies.

Typically, the touching sensation emanates from the arm and/or hand of the caregiver, and often stems from the natural position of the infant as it is held or cradled by the caregiver. Quite frequently, an uninterrupted touching sensations as that resulting from cradling will facilitate the onset of sleep, stemming from the relaxation and security resulting from the touch sensation.

SUMMARY

A wearable garment or swaddling blanket appliance includes integrated protrusions in the form of pressure accessories for simulating the slight pressure felt from a caregiver when holding or cradling an infant. The pressure accessories are enlarged or expanded areas disposed at locations on a textile base such as a blanket in a manner that they approximate the arm and hand positions of a caregiver when the swaddling appliance is engaged by wrapping around an infant. Wings or flaps of the appliance facilitate engaging the appliance around an infant such that tension in the wrapped blanket appliance induce a slight inward pressure on the pressure accessories so that the infant perceives the pressure and interprets a caregiver hold or touch.

Configurations herein are based, in part, on the observation that a human caregiver may not always be present or able to provide a continuous touching sensation, particularly of a sufficient duration to bring on sleep in an infant. Unfortunately, attempts to soothe an infant to sleep by providing a touching sensation through holding or cradling can be nullified by an external interruption of the caregiver or an attempt to release the touch prematurely, as in setting the infant in a crib.

Soon after birth, many infants show difficulty sleeping or resting in their beds away from their caregivers. Infants, when held by their caregivers, have support on their side as the caregiver holds the infant against their body or by putting their arms around the baby. The infants also may have support on their thoracic area as the caregiver puts a gentle hand on their chest or abdomen area. This type of pressure creates a warm embrace, in which the infant feels secure. When this hold is mimicked via a mechanism, it creates the same effect as being held by a caregiver. This helps the infant rest better and longer.

Accordingly, configurations herein substantially overcome the shortcomings of attempts to apply a continuous touch sensation by providing a swaddling appliance formed from a textile or blanket base having pressure accessories in the form of weighted pockets or padded regions having a mass or bulk greater than the surrounding blanket so as to provide an increased pressure simulating a caregivers arm or hand when the base is wrapped around the infant, similar to a swaddling blanket. The pressure accessories therefore form enlarged and heavier protrusions from the otherwise planar surface of the textile base, and these protrusions engage the infant with a mild pressure so as to simulate pressure applied by a caregiver's touch. The pressure accessories are filled with a bulky and/or weighted substance, such as pellets, beads or padding, that when applied with the textile base provide an increased pressure than the textile base as a whole from the additional weight and volume of the pressure accessory in conjunction with gravity and the tension of a wrapped blanket (textile base). In this manner, the pressure accessory can convey a similar perception to the infant as that of a cradling arm or hand of a caregiver, and therefore elicit similar physiologic responses indicative of comfort, relaxation and security.

The intent of the shape of the pressure accessories is to somewhat mimic human arms that have joints at the wrist and elbow which along with the fingers allow them to bend and anchor. The same effect is achieved by the weighted, elongated pressure accessories with respect to pressure applied along the length of an infant's torso when the accessory is engaged in proximity to the infant as the infant falls asleep and while sleeping. When the pressure accessories are disposed via flaps of the appliance on either side of the baby's body, their weighted quality facilitates positioning close to the infant's body creating a snug embrace around the baby. The sensation felt by the infant is thus closer to the feel and sensation of a human being holding the infant.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

FIG. 1 is a plan view of the unfolded appliance of configurations disclosed herein;

FIG. 2 is a diagram of flaps and corresponding folds of the appliance of FIG. 1;

FIG. 3 is a diagram of folding the flaps of FIG. 2 for engaging the pressure accessories against a wearer infant;

FIG. 4 is a flowchart of usage of the appliance of FIGS. 1-3;

FIG. 5 is a perspective view of an infant prior to engagement with the swaddling appliance;

FIG. 6 is a perspective view of engagement of the bottom flap (wing) of the swaddling appliance;

FIG. 7 is a perspective view of engagement of the left flap (wing) of the swaddling appliance; and FIG. 8 is a perspective view of a fully engaged swaddling appliance around an infant.

DETAILED DESCRIPTION

Depicted below are example configurations of the swaddling appliance that applies the side and thoracic pressure on an infant's body when lying down for a nap or during sleep time. Further, the disclosure provides examples of a wearable swaddling blanket, a commonly used childcare product for infants, to describe the use of the pressure accessory. The accessory, when either used as is or with subtle variations, also could be adapted for use in many other child care products such as, but not limited to, car seats, bouncy seats, strollers, swaddles etc.

Soon after birth, many infants show difficulty sleeping or resting when they are not being held by their caregivers. They rest best when held by a human. Many a times a sleeping infant will awaken as soon as they are laid down in their bed. This behavior of needing constant holding severely adds to the fatigue of the primary caregiver during the initial months post birth. Swaddling an infant in a blanket is shown to help this behavior and to lengthen sleep time. However in many cases swaddling only increases the independent resting time by merely a few minutes before the infant awakens. Experts attribute this to certain infants taking longer time to enter the state of deep sleep and having shorter sleep cycles. When the baby (infant) is held by a caregiver and if the baby comes out of the deep sleep state and enters a light sleep state, gentle pressure applied by the caregiver's arms and body lulls the baby back into the state of deep sleep without waking the baby up. The infant's sleeping habits gradually get better as he or she grows beyond 3 to 4 months of age. However the beginning months are typically when the primary caregiver needs the time to catch up on activities while the baby rests.

FIG. 1 is a plan view of the unfolded appliance of configurations disclosed herein. Referring to FIG. 1, the swaddling appliance 100 includes a textile base 110 having the general appearance of a blanket sized for wrapping or engaging an infant. In the example configuration, the base 110 includes a plurality of flaps, 120-1 . . . 120-3 (120 generally) or wings having a generally convex shape adapted to wrap around the infant engaged by the swaddling appliance 100. The base also includes one or more pressure accessories 130-1 . . . 130-3 (130 generally) adapted so as to engage the infant by applying slight pressure to the infant when the appliance 100 is wrapped, or engaged around the infant (shown in further detail below). Alternate configurations may also employ the textile base as a swaddling or blanket alone, employing the flaps and optional pockets (discussed further below), and leave the pressure accessories as optional or selectively attachable (as hook-and-loop fastened, frictionally fit or in a separate pocket or hoop.

FIG. 2 is a diagram of flaps and corresponding folds of the appliance of FIG. 1. Referring to FIGS. 1 and 2, the flaps 120 define folds 122-1 . . . 122-3 (122 generally), substantially defining the general region of the appliance 100 that will curve around the body of the wearer infant when the swaddling appliance 100 engages the infant. The side flaps 120-1, 120-2 are adapted to wrap around the torso of the infant and a bottom flap 120-3 wraps around the legs and pelvic region such that the front pressure accessory 130-3 engages a chest region of the wearer infant. Each of the flaps 120, in the example arrangement, includes a corresponding pressure accessory 130, however various arrangements may omit the pressure accessory 130 on one or more of the flaps 120. The flaps 120 and corresponding folds 122 may not necessarily define discrete portions or seams of the textile swaddling appliance 100, but rather general regions of a continuous planar blanket surface that tends to follow the body contour of the infant when wrapped around the infant with sufficient tension to engage the pressure accessories 130 against the infant in the manner described herein for simulating a touch or contact of a caregiver. The swaddling appliance 100 may be formed from a continuous textile material cut and shaped as disclosed herein.

The pressure accessories 130 are generally disposed along a region defined by the folds 122, substantially where the convex shape of the flaps 120 meets the textile base 110. Alternatively, the pressure accessories may be disposed elsewhere, such as on the bottom flap 120-3 in anticipation of folding upward around the infant, shown in FIGS. 5-8 below. The plurality of pressure accessories 130 may be of various shapes, sizes, however in the example arrangement the pressure accessories 130 include lateral chambers 130', or supports, for simulating the forearm of a caregiver holding the infant and a front chamber 130" (support) for simulating the palm of a caregiver. It should be noted that a (horizontal) central point of each side flap (or wing) that wraps is at the chest or torso region so as not to focus excessive pressure on the hips. Such pressure, if centered around the hip region and possibly too tightly wrapped has been suggested to cause dysplasia in infants under three months.

FIG. 3 is a diagram of folding the flaps of FIG. 2 for engaging the pressure accessories against a wearer infant. Referring to FIGS. 1-3, the bottom flap 120-3 folds upward as shown by arrow 140, and the side flaps 120-1, 120-2 fold around the left and right sides of the infant as shown by arrows 142 and 144, respectively. Folding the flaps 120-3 orients the front pressure accessory 130-3 in the chest region of the wearer infant, shown by the folded bottom flap 146, and folding the side flaps 120-1, 120-2 orients the lateral (side) pressure accessories 130-1, 130-2 along the right and left sides of the infant, preferably from a region from around the shoulder to mid thigh of the wearer infant. In an alternate configuration, also shown below in FIGS. 5-8, the pressure accessories 130-11, 130-12 may be disposed opposed sides of the lower flap 120-3 such that closure of the bottom flap 120-3 draws the pressure accessories to engage the infant. The pressure accessories 130 may be attached by any suitable mechanism, such as sewn textile pockets, adhered with adhesive, or integrated in layers of the textile base 110. Further, the pressure accessories may be filled with a slightly denser material, such as beads or pellets, so as to increase the pressure sensation from gravitational pull on the weighted material therein. Alternatively, fibrous filling such as polyester may also be employed if additional weight is not desired.

FIG. 4 is a flowchart of formation and usage of the appliance of FIGS. 1-3. Referring to FIGS. 1-4, a procedural approach to providing and engaging an infant using the disclosed appliance 110 is shown. At step 200, the method for employing the swaddling appliance for engaging an infant includes providing a textile base 110 adapted for swaddling an infant 150 (FIG. 5, below). In the example arrangement, the textile base 110 further includes a planar surface having convex shaped flaps 120 defining wings for engaging the infant 150 by wrapping around the infant 150, such that the pressure accessories 130 are disposed in a region where the flaps 120 meet the base 110, as depicted at step 201. The textile base is a blanket material adapted to drape and wrap around the infant, and may be any suitable textile or fabric-like material of a desired weight for providing texture and warmth.

The textile base 110 incorporates at least one pressure accessory 130 adhered to the textile base 110, such that the pressure accessory 130 is adapted to engage the infant 150 by application of pressure simulating a caregiver, as depicted at step 203. In the example arrangement, the pressure accessory 130 includes at least one elongated lateral support 130-1, 130-2 adapted to extend along a side of the infant. The flaps 120 include side flaps 120-1, 120-2 adapted to engage the infant by folding along the side of the infant, such that the pressure accessory 130 defines a curve of the flap such that the pressure accessory engages a torso region of the infant 150, as shown at step 204. The elongated lateral supports defining the side pressure accessories 120-1, 120-2 extend substantially from a shoulder of the infant to a mid thigh region.

The flaps 120 further include a bottom flap 120-3 adapted to engage the infant 150 along the front of the infant, such that the pressure accessory 130-3 becomes disposed proximate to an end of the flap 146 and positioned to engage the chest of the infant 150, thereby providing a continuous pressure sensation perceptible by the infant, as shown at step 205. In alternate arrangement, the textile base may further include a leg pouch 152 in the region of the bottom flap 120-3, such that the leg pouch 152 (FIG. 5, below) is adapted to be covered by the bottom flap 120-3 upon folding.

Engaging (swaddling) the infant further includes flexibly conforming the pressure accessory to a contour of the infant, as depicted at step 206, such that the pressure accessory engages the infant 150 by tension of the textile base 110 wrapped around the infant 150, as depicted at step 206. Either of the torso pressure accessory 130-3 or the side accessories 130-1, 130-2 may comprise a pocket in the textile base 110, such that the enclosed pocket encloses a weighting material for applying pressure to the infant 150, as shown at step 207. The weighting material may be a malleable granular substance for conforming to a contour of the infant, as depicted at step 208, or the weighting material may include any suitable material adapted to conform to a shape of the flap wrapped around the infant. Such a weighted material may comprise poly beads, Styrofoam beads, hypoallergenic material, and/or various organic materials such as walnut shells or buckwheat. Depending on the weighted filler, the pocket may be define a plurality of compartments, each of the compartments including a portion of the weighting material.

The weightiness or firmness within the bars is created by using a heavier filling that, for example plastic pellets. Such a filling offers a gentle pressure, would move with the baby's light movements. The weight offered by the weighted intervals is determined in such a way that it mimics the weight offered by the human hand on a resting baby, for example it can be approximately 0.25 to 0.5 lbs. The density of the soft filling is chosen to allow it to be flexible so that it bends and takes the desired shape and position without being too rigid. It is to be understood that various configurations of different density filing materials and different placements and spacing of these materials within the elongated bars is within the scope of the invention disclosed herein and the specific disclosed embodiments are not intended to be limiting.

Thus, the textile base 110 defines a wearable blanket and the flaps 120 define protrusions based on the appendages of the infant and adapted to wrap the torso of the infant 150 between the appendages, depicted at step 209. The textile base appears as an infant garment forming receptacles for appendages of the infant.

FIG. 5 is a perspective view of an infant prior to engagement with the swaddling appliance. Referring to FIGS. 1-3 and 5, an infant 150 lies on the textile base 110 prior to engagement with the device 100. An optional pouch 152 encases the legs for smaller infants who may not fill out the folded bottom flap 120-3. The bottom flap 120-3 is partially engaged (draw over the legs of the infant 150

FIG. 6 is a perspective view of engagement of the bottom flap (wing) of the swaddling appliance. Referring to FIG. 6, the bottom flap 120-3 is drawn or pulled over the torso of the infant 140, and the pressure accessories 120-1, 120-2 engaging the lateral sides of the infant and the center pressure accessory 130-3 engaging the chest area.

FIG. 7 is a perspective view of engagement of the left flap (wing) of the swaddling appliance 100. In FIG. 7, the left flap 120-2 is drawn to engage the infant 150 such that the pressure accessories 120-11, 120-13 are drawn or pressed into engagement with the infant 150 by the tension of the drawn flap 120-2.

FIG. 8 is a perspective view of a fully engaged swaddling appliance around an infant. Referring to FIGS. 5-8, the right flap (from the infant 150 perspective) is drawn over the left flap 120-2 and around the infant 150 to further engage the pressure appliances 130.

The paragraphs below describe the step by step mechanism to secure the swaddle blanket on the baby with help of FIGS. 5-8. As shown in FIG. 5, the infant is placed in prone position on the textile base 110 with the base of infant's neck aligned with the top edge of a back panel 110-1 defined by the center of the base 110 between the flaps 120-1, 120-2. In the case where the leg pouch 152 is present and being used, the infant's legs are inserted into the pouch 152 and the open end of the leg pouch is extended upwards over the infant's waist to the maximum possible extent.

As shown in FIG. 6, particular configurations may employ hand pockets 160-1, 160-2 (160 generally) which may be employed with either or both hands placed inside the pockets such that the finger tips extend to the enclosed U-shaped end of the pocket while the open end of the pocket extends above the infant's elbow. Engagement pulls the front panel upwards, to cover the infant's body until the top edge of each side, and the pressure accessories 130 are tucked under the respective arms. Engagement of the infant (i.e. wrapping or swaddling) should tuck each side pressure accessory 130-1, 130-2 along the side of the infant's body. In this position pressure is exerted on the infant on both the sides. In the case where a shoulder panel is present and being used, both sides of the panel may be extended over the infant's shoulders on to the infant's chest and thus under to the front panel. Secure the two ends of the shoulder panel to the front panel using hook and loop fastener pair, as shown in the figure. In this position, the thoracic pressure accessory lies along the vertical line somewhere between the chest and the waist of the infant.

FIGS. 7 and 8 show how the swaddle is wrapped around the baby's body. As shown in FIG. 7 one flap 120 is wrapped over the infant's shoulder and arm. It is then extended to the opposite side and tucked under the infant's back. A hook and loop fastener pair may be used to secure end in this position as shown. In this position, the side pressure accessory 130-1 or 130-2 may be covered partially or completely and secured in place along the wrapped side of the infant. Now, as shown in FIG. 8 the other end (flap 120) of the base defining the flap 120 is wrapped over the infant's other shoulder and arm, extended to the opposite side over the wrapped arm, tucked under the back and secured using hook and loop fastener or other suitable attachment, as shown. In this position, the side pressure accessories 130-1, 130-2 are further secured in place along the side of the infant.

While the disclosed system and method has been particularly shown and described with references to embodiments thereof, it will be understood by those skilled in the art that various changes in form and details may be made therein without departing from the scope of the invention encompassed by the appended claims.

The invention claimed is:

1. A blanket garment appliance for engaging an infant comprising:

a textile base adapted for engaging an infant, the textile base further comprising a planar surface having at least one convex shaped flap defining a wing for engaging the infant by wrapping around the infant; and at least one pressure accessory adhered to the textile base, the pressure accessory adapted to engage the infant by application of pressure simulating a caregiver, the pressure accessory adapted to flexibly conform to a contour of the infant for providing a continuous pressure sensation greater than that exerted by the planar surface alone and perceptible by the infant the flaps further comprising a bottom flap adapted for folding upward over a chest of the infant having said at least one pressure accessory disposed proximate to an end of the bottom flap and positioned to engage the chest of the infant upon upward folding; and a plurality of opposed side flaps for wrapping around a torso of the infant;

each of the flaps configured to draw the pressure accessories into ergonomic conformance with a contour of the infant for providing the continuous pressure sensation.

2. The appliance of claim 1 wherein the pressure accessory engages the infant by tension of the textile base swaddled around the infant.

3. The appliance of claim 1 wherein the pressure accessory includes at least one elongated lateral support adapted to extend along a side of the infant.

4. The appliance of claim 3 wherein the elongated lateral support extends substantially from a shoulder of the infant to a mid thigh region.

5. The appliance of claim 1 wherein the flaps include at least one side flap adapted to engage the infant by folding along the side of the infant, the pressure accessory disposed on the textile substrate such that the pressure accessory engages a torso region of the infant upon folding of the side flaps.

6. The appliance of claim 1 wherein the bottom flap further comprises a plurality of pressure accessories on opposed sided of the bottom flap, each of the pressure accessories disposed to engage a respective side of the infant upon upward folding of the bottom flap.

7. The appliance of claim 1 wherein the textile base further comprises a leg pouch adapted to be covered by the bottom flap upon folding.

8. The appliance of claim 1 wherein the pressure accessory further comprises a pocket in the textile base, the enclosed pocket enclosing a weighting material for applying pressure to the infant.

9. The appliance of claim 8 wherein the weighting material is a malleable granular substance for ergonomically conforming to a contour of the infant.

10. The appliance of claim 8 wherein the pocket comprises a plurality of compartments, each of the compartments including a portion of the weighting material.

11. The appliance of claim 1 wherein the textile base is a wearable blanket for accommodating the appendages of the infant and adapted to wrap the torso of the infant between the appendages.

12. The appliance of claim 1 wherein the textile base is an infant garment having flaps positioned to engage the pressure accessories for applying the continuous pressure sensation.

13. The appliance of claim 1 wherein the pressure accessory further comprises a thoracic pressure accessory disposed along a line between the chest and the waist of the infant.

14. The appliance of claim 1, wherein the convex shaped flaps define wings for engaging the infant by wrapping around the infant, such that the pressure accessories are disposed in a region where the convex shaped flaps meet the base in a fold.

15. The appliance of claim 1, wherein the continuous pressure sensation exerts a force that mimics the weight of a caregivers hand.

16. The appliance of claim 15, wherein the force exerted is based on a percentage of the weight of the infant.

17. A method for simulating an infant caregiver's touch comprising:

providing a textile base adapted for engaging an infant the textile base further comprising a planar surface having convex shaped flaps defining convex extensions in the planar surface for engaging the infant by wrapping around the torso of the infant; and adhering at least one pressure accessory to the textile base, the pressure accessory adapted to engage the infant by application of pressure simulating a caregiver, the pressure accessory adapted to flexibly conform to a contour of the infant for providing a continuous pressure sensation greater than that exerted by the planar surface alone and perceptible by the infant; and the convex shaped flaps including a bottom flap having at least one pressure accessory disposed proximate to an end of the bottom flap and positioned to engage the chest of the infant upon upward folding.

18. The method of claim 17 wherein the flaps include side flaps adapted to engage the infant by folding along the side of the infant, the pressure accessory disposed on the textile substrate such that the pressure accessory engages a torso region of the infant upon wrapping of the flaps.

19. The method of claim 17 further comprising:

folding a bottom flap upward over a chest of the infant; and wrapping a plurality of opposed side flaps around a torso of the infant, each of the flaps configured to draw the pressure accessories into ergonomic conformance with a contour of the infant for providing the pressure sensation;

wherein the flaps include a bottom flap adapted to engage the infant along the front of the infant;

at least one pressure accessory disposed proximate to an end of the bottom flap and positioned to engage the chest of the infant upon upward folding;

a plurality of pressure accessories on opposed sides of the bottom flap, each of the pressure accessories disposed to engage a respective side of the infant upon upward folding of the bottom flap; and the side flaps for engaging the infant and the pressure accessory by wrapping over the bottom flap.

20. A garment, comprising:

a planar base, the base defined by a flexible sheet of garment material;

at least one pressure region on the planar base defining a location at which a touch from a caretaker is expected when the material engages an infant by wrapping the material around the infant;

a pressure accessory adhered to each of the pressure regions, the pressure accessory having a greater mass and bulk than the planar pressure region to which it is adhered;

the pressure accessory configured to apply pressure to the infant at the pressure region, the pressure region based on a determined location on the infant where pressure from a caregiver's arm or hand would be applied to a held infant;

the pressure from the pressure accessory greater than that exerted by the planar base alone; and the planar base further including a plurality of flaps, each of the flaps defining a pressure region, the pressure region configured for engaging the determined location when the flap is wrapped around the infant.

21. The garment of claim 20 wherein the plurality of flaps further comprise right and left side flaps having right and left pressure regions corresponding to right and left torso sides of the infant for simulating a caregivers arm.

22. The garment of claim 21 wherein the pressure accessories further comprise an enlarged and expanded volume greater than the planar base on which they are adhered, disposed at locations on a textile base for approximating the arm and hand pressure of a caregiver when the planer base is engaged by wrapping around the infant.

23. The garment of claim 22 wherein the planar base further includes a front flap, the front flap defining a pressure accessory for a pressure region corresponding to a chest of the infant, the front flap having a pouch for engaging legs of the infant based on an infant size.

* * * * *